US005216788A

United States Patent [19]

Bock

[11] Patent Number: 5,216,788

[45] Date of Patent: Jun. 8, 1993

[54] IMPACT-PROTECTED SAFETY BELT BUCKLE

[75] Inventor: Andreas Bock, Notorf, Fed. Rep. of Germany

[73] Assignee: Autoflug GmbH & Co. Fahrzeugtechnik, Rellingen, Fed. Rep. of Germany

[21] Appl. No.: 778,217

[22] PCT Filed: May 8, 1991

[86] PCT No.: PCT/DE91/00391

§ 371 Date: Dec. 13, 1991

§ 102(e) Date: Dec. 13, 1991

[87] PCT Pub. No.: WO91/17678

PCT Pub. Date: Nov. 28, 1991

[30] Foreign Application Priority Data

May 13, 1990 [DE] Fed. Rep. of Germany ..... 4015235

[51] Int. Cl.[5] ..... A44B 11/00

[52] U.S. Cl. ..... 24/633; 24/637; 24/641

[58] Field of Search ..... 24/633, 634, 635, 636, 24/637, 641, 642, 652

[56] References Cited

U.S. PATENT DOCUMENTS

| | | | |
|---|---|---|---|
| 4,004,115 | 1/1977 | Esner | 24/641 |
| 4,384,391 | 5/1983 | Lindblad et al. | 24/633 |
| 4,527,317 | 7/1985 | Straszewski et al. | 24/637 |
| 4,597,141 | 7/1986 | Wier | 24/633 |
| 4,621,394 | 11/1986 | Wier | 24/641 |
| 5,029,369 | 7/1991 | Oberhardt et al. | 24/633 |

FOREIGN PATENT DOCUMENTS

| | | | |
|---|---|---|---|
| 2443275 | 4/1975 | Fed. Rep. of Germany | 24/641 |
| 2719325 | 11/1977 | Fed. Rep. of Germany . | |
| 2849437 | 5/1980 | Fed. Rep. of Germany . | |
| 2903230 | 7/1980 | Fed. Rep. of Germany . | |
| 3537465 | 4/1987 | Fed. Rep. of Germany . | |
| 3811429 | 10/1989 | Fed. Rep. of Germany . | |

*Primary Examiner*—Victor N. Sakran
*Attorney, Agent, or Firm*—Robert W. Becker & Associates

[57] ABSTRACT

A safety belt buckle for receiving and locking an insertion tongue is comprised of a casing having an insertion slot, an insertion tongue that is slidably mounted in the insertion slot and has a cutout, a spring-loaded ejector, arranged in the insertion slot and acting on the insertion tongue, and a locking device mounted inside the casing and cooperating with the cutout of the insertion tongue for locking the insertion tongue in the insertion slot in a locking position of the safety belt buckle. Furthermore, a spring-loaded sliding key is guided within the casing and comprises a sliding key body and a key button The key button is slidably connected to the sliding key body. The sliding key cooperates with the locking device to unlock the safety belt buckle. A sensor spring is mounted between the sliding key body and the key button for holding the key button in an extended position relative to the sliding key body and essentially maintaining the extended position when acceleration forces occur in an unlocking direction of the safety belt buckle. The sensor spring also translates a relative displacement of the key button from the extended position in the unlocking direction, caused by manual actuation of the key button, into a release action of the locking device, whereby the sliding key body and the key button, when acceleration forces occur and when the key button is not actuated, is insertable into the casing in the unlocking direction of the safety belt buckle without releasing the locking device.

11 Claims, 4 Drawing Sheets

IMPACT-PROTECTED SAFETY BELT BUCKLE

BACKGROUND OF THE INVENTION

The invention relates to a safety belt buckle for receiving and locking an insertion tongue, having a housing with an insertion slot for the insertion tongue with a spring-loaded ejector arranged in the insertion slot, and a locking device cooperating with a cutout of the insertion tongue in a locking position, whereby the locking device locks the insertion tongue in the insertion slot, and further having a spring-loaded and two-part sliding key for releasing the locking device, the sliding key comprising a sliding key body and a key button which is insertable into the sliding key body, whereby a spring in the form of a sensor spring is arranged between the sliding key body and the key button for holding the key button in an essentially extended position when acceleration forces occur, and whereby, when the key button is manually activated, a relative displacement between the key button and the sliding key body is translated into the actuation of the locking device.

A safety belt buckle of the aforementioned kind is described in DE-OS 38 11 429; it is suggested that the sliding key body is locked relative to the casing of the safety belt buckle so that, when acceleration forces occur, the safety belt body remains in its resting position whereby the insertion of the key button caused by the acceleration forces will not release the sliding key body from its locked position within the safety belt buckle casing. Only the manual actuation of the key button releases the sliding key body from its locked position within the safety belt buckle casing so that with the progressing unlocking stroke the sliding key body causes the unlocking of the locking mechanism.

The known safety belt buckle has the disadvantage that the locking device of the sliding key body within the safety belt buckle casing which is to be released causes a resistance against the opening movement of the safety belt buckle performed by the user so that thereby the operating comfort of the safety belt buckle is reduced. Furthermore, the locking forces, on the one hand, and the opening forces which result from the insertion of the key button into the sliding key body, on the other hand, must be exactly coordinated with one another in order to prevent, with a due safety margin, an unlocking of the sliding key body within the safety belt buckle casing. Also, the known safety belt buckle is of a complicated design because the means for locking the sliding key body, on the one hand, and for releasing the locking device, on the other hand, must be supported in a respective manner.

It is therefore an object of the present invention to improve a safety belt buckle of the aforementioned kind such that the safety belt buckle is impact-protected against acceleration forces acting in the actuation direction of the sliding key while maintaining a high operating comfort, whereby the design of the safety belt buckle should be simple.

SUMMARY OF THE INVENTION

The solution to this problem, inclusive advantageous embodiments and developments, may be taken from the contents of the claims which are appended to the description.

In its basic concept the invention provides that the sliding key body with the key button is insertable into the safety belt buckle casing without releasing the locking device when acceleration forces occur and the key button is not actuated.

With the inventive embodiment it is advantageous that an actuation of the locking device of the safety belt buckle will occur only when the key button is inserted into the sliding key body and is then moved together with the sliding key body in the direction of the unlocking movement for the locking device of the safety belt buckle. Only the insertion of the key button into the sliding key body results in the formation of an outer contour of the sliding key body with respectively projecting parts via which the sliding key body may act on the locking device. As long as the key button is not inserted into the sliding key body, the sliding key body is freely slidable within the safety belt buckle casing, for example, due to acceleration forces, without actuation of the locking device. In this embodiment respective measures must be taken only by selecting the sensor spring between the sliding key body and the key button such that in the case of an impact-like event the key button is not insertable, respectively, not partially insertable into the sliding key body since insertion would result in the actuation respectively unlocking of the locking device. The commonly employed travel stroke for compensating manufacturing tolerances is shown in the drawing. In the event of an impact the sliding key body inclusive the key button may move within the safety belt buckle casing without acting on the locking device so that in an advantageous manner the sensor spring must compensate only the mass of the key button, and not the mass of the entire sliding key with sliding key body and key button, against impact.

According to one embodiment it is suggested that a pivoting lever is arranged within the sliding key body and is actuatable by the key button upon its insertion into the sliding key body, so that the pivoting lever is pivotable such that it projects from the contour of the sliding key body and thereby forms an abutment for actuating the locking device. Here, the pivoting lever acts as a transmitting element with which the insertion movement of the key button into the sliding key body during the normal actuation of the safety belt buckle results in a pivoting of an abutment for the actuation of the locking device out of the sliding key body. Since it is simultaneously provided that the pivoting lever is held in a position, in which it is immersed in the contour of the sliding key body, via a return spring that is supported at the sliding key body, according to the present invention, the sliding key body is freely slidable within the safety belt buckle casing according to the present invention without actuating the locking device the sliding key button is not inserted into the sliding key body. Only the insertion of the key button into the sliding key body with the corresponding relative movement results in the actuation of the pivoting lever and in the pivoting of a respective abutment for the actuation of the locking device. Of course, acceleration forces will also act on the pivoting lever so that the pivoting lever should be supported at its point of gravity, respectively, based on a respective mass distribution, should exhibit a behavior which assists the spring that supports the pivoting lever.

According to another embodiment an actuating rod which supports the key button is arranged within the sliding key body such that a movement of the key button relative to the sliding key body results in the end of the actuating rod protruding from the contour of the sliding key body, thus actuating i.e., unlocking the locking device of the safety belt buckle. In t his embodiment the arrangement of a separate transmitting element is obsolete, instead an actuating rod which simultaneously serves to guide the key button is used as a transmitting element for the actuation (unlocking) of the locking device. Preferably, the actuating rod is guided in a channel which penetrates the sliding key body at a slant resulting in a displacement of the key button relative to the sliding key body upon actuation of the key button.

In order to avoid this disadvantage it is suggested according to the present invention to embody the actuating rod in the form of a plurality of segments that are connected to one another in a movable manner so that a straight channel with a straight movement of the key button may be provided, the channel being curved only in its end section such that the end of the actuating rod may protrude from the contour of the sliding key body.

With embodiments having an actuation rod that is guided in a channel it is expedient that the actuating rod is provided with a projection that engages a recess within the sliding key body and determines the displacement of the actuating rod.

In a preferred embodiment of the invention the key button with actuating rod, the sensor spring and the sliding key body is formed from a plastic material as a single part whereby the sensor spring between the key button and the sliding key body is connected via respective very thin joint means to the aforementioned elements. Such single parts may be produced in a simple manner, especially by injection-molding processes, and are easily insertable into the mechanism of the safety belt buckle.

The invention is not limited to the safety belt buckles of the aforementioned kind in which the movement of the sliding key is directly acting on the latch of the locking device but is also adaptable to other safety belt buckle constructions in which a latch that is supported at the safety belt buckle casing in a self-opening manner is secured in a locked position by a securing element. Such a construction of a safety belt buckle is demonstrated, for example, in DE-OS 27 19 325. The invention is also suitable for such safety belt buckles; the sliding key body acts on the securing element with an abutment that protrudes from the contour of the sliding key body upon actuation of the key button, whereby the securing element upon further movement of the sliding key is moved into its release position so that the latch which is provided in a self-opening manner is moved into the release position for the insertion tongue.

BRIEF DESCRIPTION OF THE DRAWINGS

In the drawing embodiments of the invention are represented which will be described in the following paragraphs. It is shown in.

DESCRIPTION OF PREFERRED EMBODIMENTS

The embodiment shown in the figures represents a safety belt buckle in which the latch of the safety belt locking device is secured by a securing element that is guided within the safety belt buckle casing. The securing element is engaged by the sliding key during its unlocking movement. Since the locking mechanism is not the object of the present invention, the safety belt buckle may also be embodied such that the sliding key during its unlocking movement acts directly on the latch.

Figure 1:
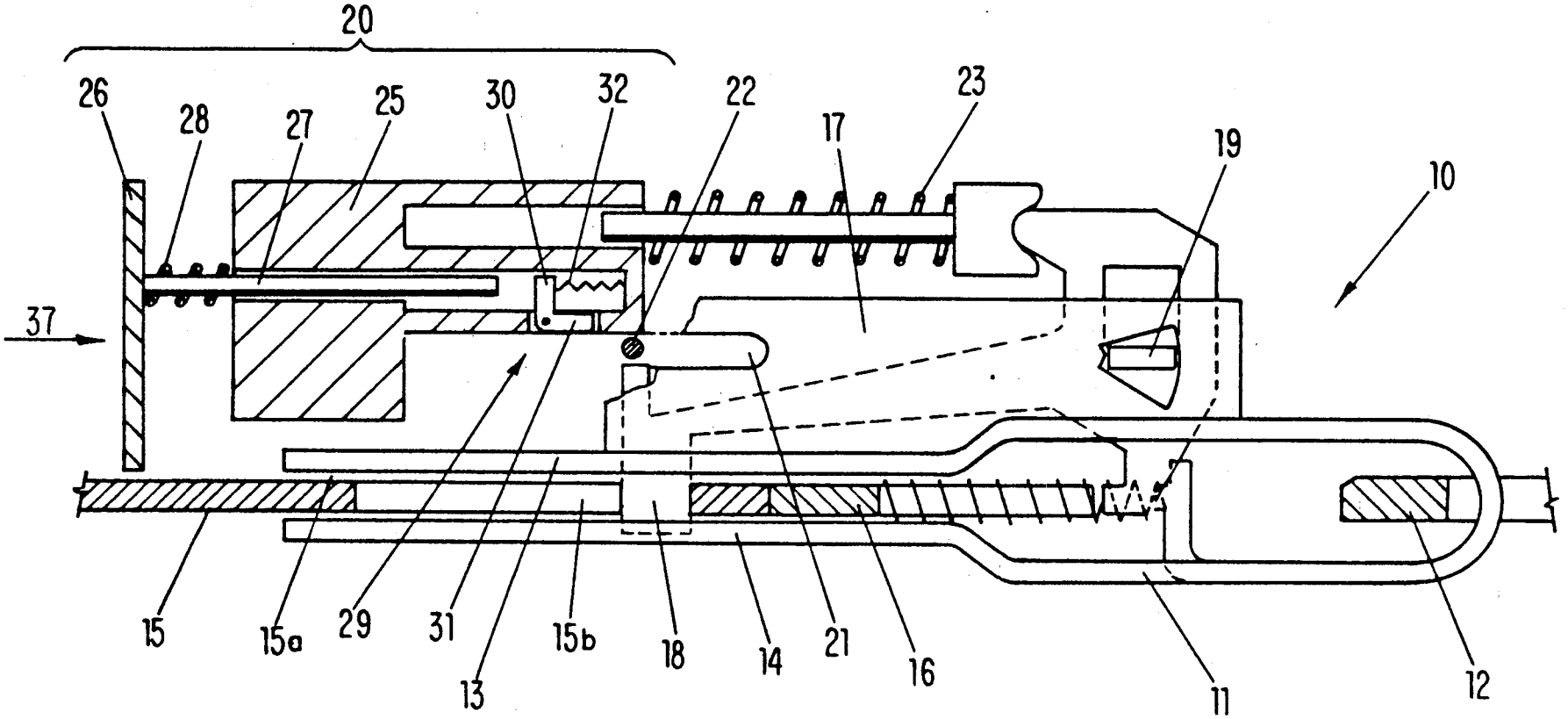
FIG. 1 a safety belt buckle in a longitudinal cross-sectional view.

According to FIG. 1 the safety belt buckle 10 is comprised of a one-part buckle plate 11 which in the area of its mounting at the anchoring part 12 is bent to form legs 13, 14 of equal length between which an insertion tongue 15 having a cutout 15*b* is insertable. In to the insertion slot 15*a* against the action of an ejector 16. The safety belt buckle 10 is provided with two side walls 17 which provide a U-shaped form to the safety belt buckle 10. At the far end of the side walls 17 a latch 18, extending vertically relative to the insertion plane into the cutout 15*b* of the insertion tongue 15, is pivotably supported at a joint 19. The latch 18 is secured by a securing element 22 which is slidably arranged at the side walls 17 of the safety belt buckle 10 and is slidable in the same direction as the sliding key 20. The securing element 22 is slidably guided in slotted holes 21 of the side walls 17. In its securing position which is arranged in the vicinity of the sliding key 20 the securing element 22 rests on a projection of the latch 18 and secures it against opening. During the unlocking movement the sliding key 20 cooperates with the inventive embodiment of the securing element 22 which will be described further infra, and moves the securing element into a release position of the latch 18. Thus, the latch 18 and the securing element 22 form the locking device of the safety belt buckle.

The sliding key 20 is comprised of a sliding key body 25 and a key button 26 which is guided by an actuating rod 27 in the sliding key body 25. Between the sliding key body 25 and the key button 26 a sensor spring 28 is arranged which prestresses the key button 26 in its extended resting position. The sensor spring 28 is dimensioned such that when acceleration forces occur in the direction of movement of the sliding key the sensor spring 28 is able to maintain the key button in its extended position. The contour of the sliding key body 25 is dimensioned such that it is freely slidable relative to the securing element 22.

A pivoting lever 29 is supported within the sliding key body 25 such that one leg 30 cooperates with the actuating rod 27 of the key button 26 and that the other leg 31 protrudes from the contour of the sliding key body 25 upon pivoting of the pivoting lever 29. The pivoting lever 29 is held in its initial position, in which it is immersed in the contour of the sliding key body 25, by a return spring 32 which is supported between the leg 30 and the sliding key body 25. In the initial position of the pivoting lever the key button 26 is in its extended position.

Figure 2A:
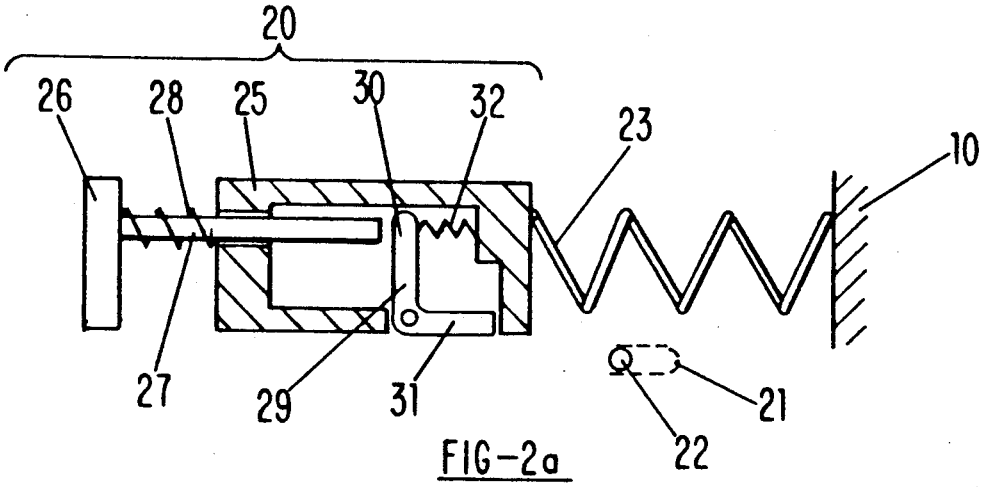
FIGS. 2*a–c* a schematic representation of the movement stages of the sliding key under given leads, FIGS. 3*a, b* another embodiment of the sliding key in its initial position and its actuated position.
Figure 2B:
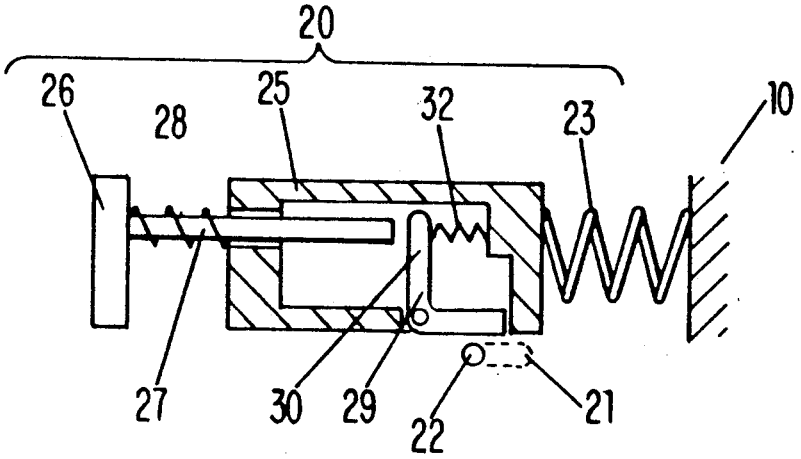

FIG. 2*a* shows a schematic representation of the sliding key in its initial position. FIG. 2*b* shows the behavior of the sliding key when a sudden impact results in acceleration forces which, without the inventive embodiment, would cause the unlocking of the safety belt buckle. After in a first step the safety belt buckle is tightened in the direction of the arrow 37, at the end of the tightening step a strong deceleration of the safety belt buckle body occurs so that the sliding key 20 will try to continue its movement in the direction of tightening 37 thereby performing an insertion movement into the safety belt buckle. Since due to the sensor spring 28 an insertion of the key button 26 into the sliding key body 25 in the direction of the arrow 37 is prevented, an insertion of the sliding key 20 into the safety belt buckle due to the effect of the occurring acceleration forces is acceptable because, as can be seen in FIG. 2*b*, the sliding key 20 is freely slidable relative to the securing element 22 so that the insertion of the sliding key 20 into the safety belt buckle 10 does not result in the unlocking of the safety belt buckle.

Figure 2C:
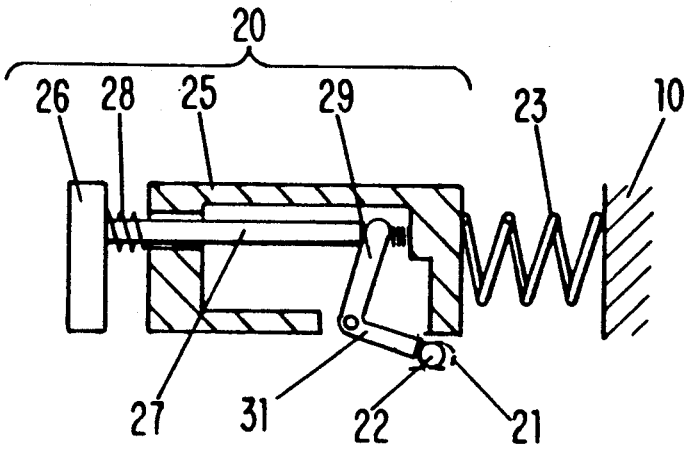

From FIG. 2*c* the course of movement resulting from the actuation of the sliding key 20 for the desired unlocking of the safety belt buckle is demonstrated. Pressure is exerted on the key button 26 and, by overcoming the force of the spring 28, the key button is inserted into the sliding key body 25 whereby the actuating rod 27 pivots the pivoting lever 29 so that the leg 31 protrudes from the contour of the sliding key body 25, and, upon the further insertion of the sliding key body 25 into the safety belt buckle casing against the action of the sliding key spring 23, the securing element 22 is actuated and moved into its release position. Thus, for a desired unlocking a course of movement for releasing the safety belt buckle is ensured.

Figure 3A:
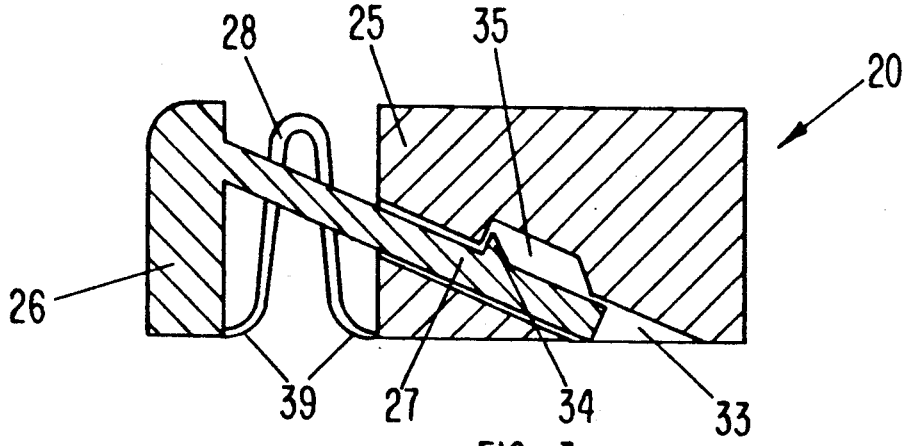
Figure 3B:
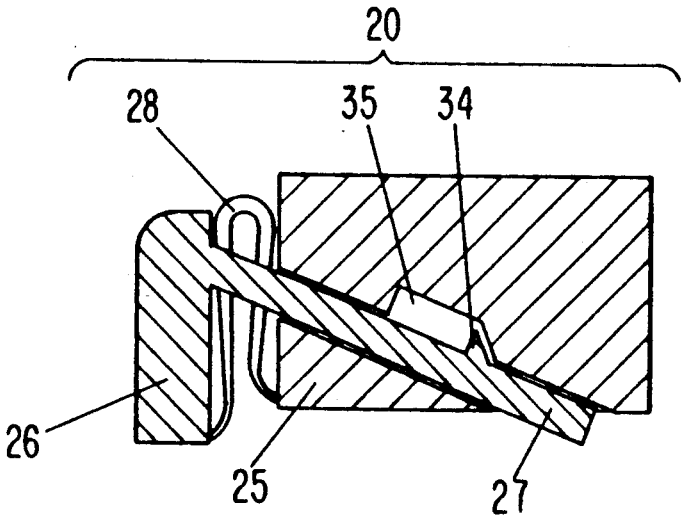
Figure 4:
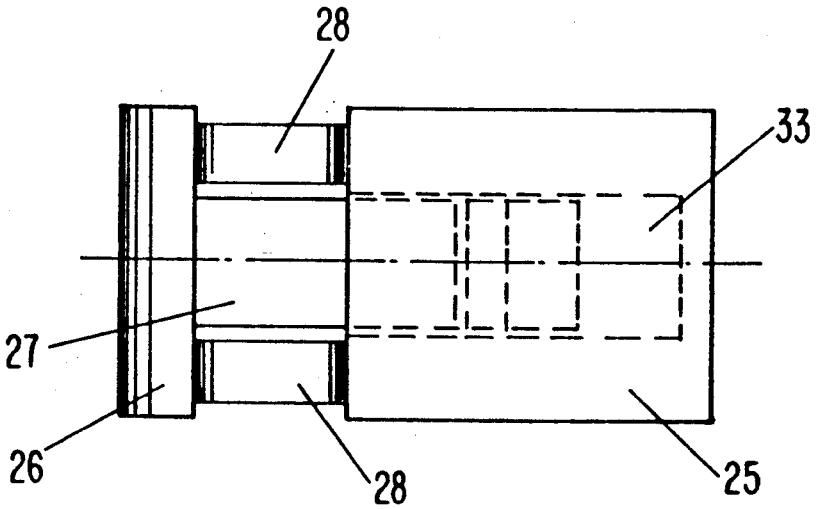
FIG. 4 a plan view of the sliding key according to FIG. 3*a;*

The embodiment represented in FIGS. 3*a, b* and 4 have an actuating rod 27 which supports the key button 26 and is guided in a channel 33 which penetrates the sliding key body 25 at a slant. The actuating rod 27 is slidable in a longitudinal direction such that when the key button 26 is pushed into the sliding key body 25 the free end of the actuating rod 27 protrudes from the contour of the sliding key body 25 and forms the abutment for the actuation of the securing element 22. For securing the actuating rod 27 within the sliding key body 25 and for determining its displacement, the actuating rod 27 is provided with a projection 34 which is guided in a corresponding recess 35 of the sliding key body 25. The sensor spring 28 which is arranged between the sliding key body 25 and the key button 26 is formed from plastic material, as are the key button and the sliding key body, and is connected via very thin joint means 39 to the aforementioned elements to form a single part so that the sliding key body 25, the key button 26 with the actuating rod 27 and the sensor spring 28 may be manufactured from plastic as an injection-molding part. When the key button 26 is inserted into the sliding key body 25 a lateral displacement of the key button relative to the sliding key body is observed due to the slanted arrangement of the channel 33.

Figure 5A:
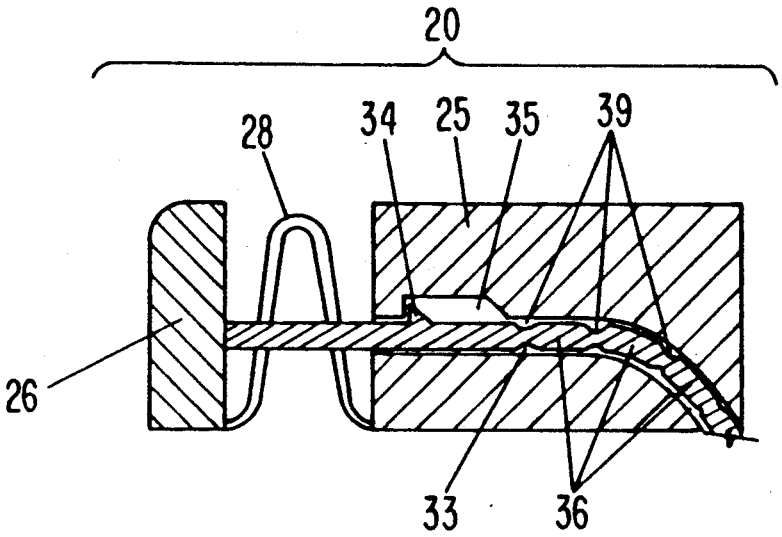
FIGS. 5*a, b* a further embodiment of the sliding key corresponding to the representation in FIGS. 3*a, b.*
Figure 5B:
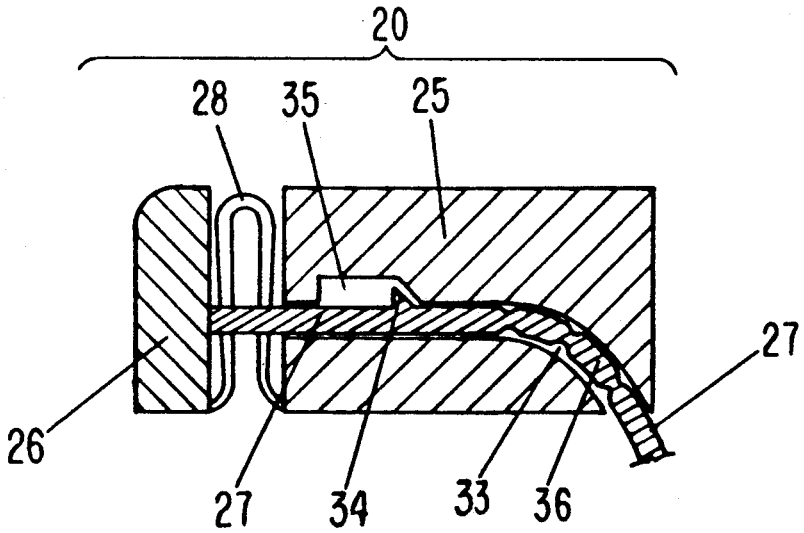

In order to avoid this lateral displacement the actuating rod 27, according to the embodiment of the FIGS. 5*a, b*, may be guided in a straight channel 36 arranged in the sliding key body 25. The channel 36 is curved in its end section so that the actuating rod 27 comprised of segments 36, which are connected to one another in a movable manner via very thin joint menas 36, protrudes with its free end from the contour of the sliding key body 25.

The present invention is, of course, in no way restricted to the specific disclosure of the specification and drawings, but also encompasses any modifications within the scope of the appended claims.

What I claim is:

1. A safety belt buckle for receiving and locking an insertion tongue, said safety belt buckle comprising:

a casing having an insertion slot;

an insertion tongue slidably mounted in said insertion slot and having a cutout;

a spring-loaded ejector arranged in said insertion slot and acting on said insertion tongue;

a locking device mounted inside said casing and cooperating with said cutout of said insertion tongue for locking said insertion tongue in said insertion slot in a locking position of said safety belt buckle;

a spring-loaded sliding key guided within said casing and comprising a sliding key body and a key button, said key button being slidably connected to said sliding key body, said sliding key cooperating with said locking device to unlock said safety belt buckle; and a sensor spring, mounted between said sliding key body and said key button, for holding said key button in an extended position relative to said sliding key body and essentially maintaining said extended position when acceleration forces occur in an unlocking direction of said safety belt buckle, and for translating a relative displacement from said extended position in said unlocking direction, caused by manual actuation of said key button, into a release action of said locking device, with said sliding key body and said key button, when said acceleration forces occur and when said key button is not actuated, being insertable into said casing in said unlocking direction of said safety belt buckle without releasing said locking device.

2. A safety belt buckle according to claim 1, further comprising a pivoting lever mounted in a pivotable manner at said sliding key body and actuatable by said key button upon insertion thereof into said sliding key body such that said pivoting lever is pivoted out of a resting position thereof to release said locking device.

3. A safety belt buckle according to claim 2, further comprising a return spring mounted between said pivoting lever and said sliding key body, said return spring forcing said pivoting lever into said resting position.

4. A safety belt buckle according to claim 2, wherein, in said resting position, said pivoting lever is completely immersed in said sliding key body.

5. A safety belt buckle according to claim 1, further comprising an actuating rod fixedly connected with a first end to said key button, said actuating rod being slidable in said sliding key body such that, when said key button performs a displacement relative to said sliding key body in said unlocking direction, a second end of said actuating rod protrudes from said sliding key body and releases said locking device.

6. A safety belt buckle according to claim 5, wherein said sliding key body has a channel for receiving said actuating rod.

7. A safety belt buckle according to claim 6, wherein said channel extends at a slant relative to a longitudinal axis of said sliding key body.

8. A safety belt buckle according to claim 6, wherein said channel has a recess, with a length of said recess defining a displacement of said actuating rod, said actuating rod having a projection engaging said recess.

9. A safety belt buckle according to claim 6, wherein said actuating rod is comprised of individual segments that are connected to one another so as to be movable relative to one another, and wherein said channel is curved.

10. A safety belt buckle according to claim 5, wherein said key button, said actuating rod, said sensor spring and said sliding key body are formed from plastic material as one single part, with said sensor spring being connected by film joints to said key button and said sliding key body.

11. A safety belt buckle according to claim 1, wherein said locking device comprises a latch and a securing element, said latch being arranged in a self-opening manner and held in a locked position thereof by said securing element, and wherein said key button, when displaced relative to said sliding key body in said unlocking direction, acts on said securing element to release said locking device.

* * * * *